US007455733B2

(12) United States Patent
Lee et al.

(10) Patent No.: US 7,455,733 B2
(45) Date of Patent: Nov. 25, 2008

(54) FLUORESCENT MATERIAL COATING APPARATUS AND METHOD OF COATING FLUORESCENT SUBSTANCE USING THE SAME

(75) Inventors: Young-Chul Lee, Yongin-si (KR); Dong-Gil Kim, Seoul (KR); Sung-Jung Kim, Seoul (KR); Jeon-Gu Kim, Suwon-si (KR); Hong-Lae Cho, Yongin-si (KR)

(73) Assignee: DMS Co., Ltd. (KR)

( * ) Notice: Subject to any disclaimer, the term of this patent is extended or adjusted under 35 U.S.C. 154(b) by 4 days.

(21) Appl. No.: 11/363,352

(22) Filed: Feb. 27, 2006

(65) Prior Publication Data

US 2006/0198947 A1 Sep. 7, 2006

(30) Foreign Application Priority Data

Mar. 4, 2005 (KR) ..... 10-2005-0018191
Aug. 12, 2005 (KR) ..... 10-2005-0074404
Aug. 12, 2005 (KR) ..... 10-2005-0074408

(51) Int. Cl.
*B05C 3/00* (2006.01)
*B05D 5/06* (2006.01)

(52) U.S. Cl. ..... 118/423; 118/50; 118/66; 427/67

(58) Field of Classification Search ..... 118/50, 118/58, 64, 66, 423; 427/238, 67, 235
See application file for complete search history.

(56) References Cited

U.S. PATENT DOCUMENTS 1,388,353 A * 8/1921 McQuitty ..... 118/407
2,179,288 A * 11/1939 Frech ..... 427/67
2,303,290 A * 11/1942 Michael ..... 427/67
2,318,060 A * 5/1943 Cortese ..... 427/157
2,643,956 A * 6/1953 Kuebler et al. ..... 427/67
6,497,916 B1 * 12/2002 Taylor et al. ..... 427/2.24
2002/0150832 A1 * 10/2002 Kinoshita et al. ..... 430/133

* cited by examiner

*Primary Examiner*—Brenda A Lamb
(74) *Attorney, Agent, or Firm*—Barnes & Thornburg LLP

(57) ABSTRACT

There is provided a fluorescent material coating apparatus for a fluorescent lamp. The fluorescent material coating apparatus includes a cassette on which a plurality of glass tubes are detachably mounted, a delivery member having a delivery chamber communicating with first ends of the glass tubes, a negative pressure generating unit for allowing fluorescent solution to be drawn into the glass tubes by generating a negative pressure in the glass tubes communicating with the delivery chamber by lowering the pressure of the delivery chamber, a dry air supplying unit for supplying dry air to the delivery chamber to dry the fluorescent solution applied on inner surfaces of the glass tubes, a solution tank containing the fluorescent solution and disposed below the glass tubes mounted on the cassette, and a moving unit for allowing lower end portions of the glass tubes mounted in the delivery chamber to be dipped into the fluorescent solution contained in the solution tank.

15 Claims, 11 Drawing Sheets

FLUORESCENT MATERIAL COATING APPARATUS AND METHOD OF COATING FLUORESCENT SUBSTANCE USING THE SAME

CROSS-REFERENCE TO RELATED APPLICATIONS

This application claims priority to and the benefit of Korean Patent Application No. 10-2005-0018191, filed with the Korean Intellectual Property Office on Mar. 4, 2005, and Korean Patent Application Nos. 10-2005-0074404 and 10-2005-0074408, filed with the Korean Intellectual Property Office on Aug. 12, 2005, the entire contents of which are incorporated herein by reference.

BACKGROUND OF THE INVENTION

1. Field of the Invention

The present invention relates to a fluorescent material coating apparatus that can effectively apply a fluorescent solution to inner surfaces of glass tubes for fluorescent lamps and dry the fluorescent solution applied on the inner surfaces at a uniform drying temperature, and a method of coating the fluorescent substance using such an apparatus.

2. Description of the Related Art

Generally, a fluorescent lamp is classified as a cold cathode fluorescent lamp (CCFL) or an external electrode fluorescent lamp (EEFL). Since the EEFL has high light emission quality, a long service life, and low power consumption, and it can be manufactured in a compact size, it has recently been used as a backlight for a liquid crystal display (LCD).

The EEFL includes a glass tube having an inner surface coated with a fluorescent material. After a predetermined amount of argon gas and mercury is injected into the glass tube, it is sealed. Opposite ends of the glass tube are each enclosed with two electrodes for applying an electric current thereto.

The EEFL is manufactured through a series of processes such as coating the fluorescent material on the inner surface of the glass tube, injecting the light emission gas and mercury into the glass tube, sealing the glass tube, and enclosing the opposite ends of the glass tube with the electrodes.

The fluorescent material coating process is one of the most important processes for determining the light emission quality of the fluorescent lamp. The fluorescent material coated on the inner surface of the fluorescent lamp functions to excite ultraviolet rays to emit visible light when the ultraviolet rays are emitted by collisions between electrons and mercury atoms after the discharge of electrons.

The fluorescent material coating process includes a process of applying a fluorescent solution on an inner surface of the glass tube and a process for drying the applied fluorescent solution. The fluorescent material coating process is performed by a rotary method in which first ends of three to five glass tubes are inserted into holes formed along a circumference of a disk-shaped stage that has a coating section and a drying section, and the fluorescent material is coated as the stage rotates.

The fluorescent solution used in the coating process is a mixture containing an organic solvent, a binder, and a settling agent. The organic solvent may be a volatile organic solvent such as butyl-acetate.

The glass tube that is applied with the fluorescent solution is dried by volatilizing the organic solvent by supplying hot air at a temperature of about 150° into the glass tube.

Particularly, in the drying process, it is important to dry the applied fluorescent solution such that a thickness of the coated fluorescent layer can be uniform.

However, in the coating process using the rotary method, since the fluorescent material applying and drying processes are performed in a state where only three to five glass tubes are mounted on the disk-shaped stage, it is difficult to mass-produce the fluorescent lamps. Furthermore, since a worker loads the glass tubes on the stage one by one, and when the coating process is finished, separates the glass tubes from the stage one by one, the working process is complicated and the holding time excessively increases.

Particularly, when the fluorescent solution applied on the inner surface of the glass tubes is dried, the hot air is supplied only into the glass tube. Therefore, there is a temperature difference between the outer and inner surfaces the glass tube.

Furthermore, there is also a temperature difference between the hot air inlet and outlet. As a result, a thickness of the fluorescent layer is not uniform and a surface of the fluorescent layer is uneven.

SUMMARY OF THE INVENTION

The present invention has been made in an effort to solve the above-described problems of the prior arts.

It is an object of the present invention to provide a fluorescent material coating apparatus that can easily apply and dry a fluorescent material, coat a fluorescent material on a plurality of glass tubes at once, and improve the coating quality by providing a uniform drying temperature to the glass tubes during the drying process.

To achieve this object, the present invention provides a fluorescent material coating apparatus for a fluorescent lamp, including: a cassette on which a plurality of glass tubes are detachably mounted; a delivery member having a delivery chamber communicating with first ends of the glass tubes; a negative pressure generating unit for allowing fluorescent solution to be drawn into the glass tubes by generating a negative pressure in the glass tubes communicating with the delivery chamber by lowering the pressure of the delivery chamber; a dry air supplying unit for supplying dry air to the delivery chamber to dry the fluorescent solution applied on inner surfaces of the glass tubes; a solution tank disposed below the glass tubes mounted on the cassette and containing the fluorescent solution; and a moving unit for allowing lower end portions of the glass tubes mounted in the delivery chamber to be dipped into the fluorescent solution contained in the solution tank.

It is another object of the present invention to provide a fluorescent material coating method using such a fluorescent material coating apparatus.

To achieve this object, the present invention provides a method of coating the fluorescent material on inner surfaces of glass tubes for fluorescent lamps, the method including: allowing the glass tubes to communicate with a delivery chamber; allowing lower portions of the glass tubes to contact the fluorescent solution contained in a solution tank; generating a negative pressure in the delivery chamber to draw the fluorescent solution into the glass tubes; releasing the negative pressure to discharge the fluorescent solution out of the glass tubes; and supplying hot air to the delivery chamber to dry the fluorescent solution applied to the inner surfaces of the glass tubes.

BRIEF DESCRIPTION OF THE DRAWINGS

The above and other features and advantages of the present invention will become more apparent by describing exemplary embodiments thereof in detail with reference to the attached drawings, in which.

DETAILED DESCRIPTION OF THE INVENTION

The present invention will now be described more fully with reference to the accompanying drawings. The descriptions of the embodiments will fully convey the concept of the invention to those skilled in the art.

The invention may, however, be embodied in many different forms and should not be construed as being limited to the embodiments set forth herein.

Figure 1:
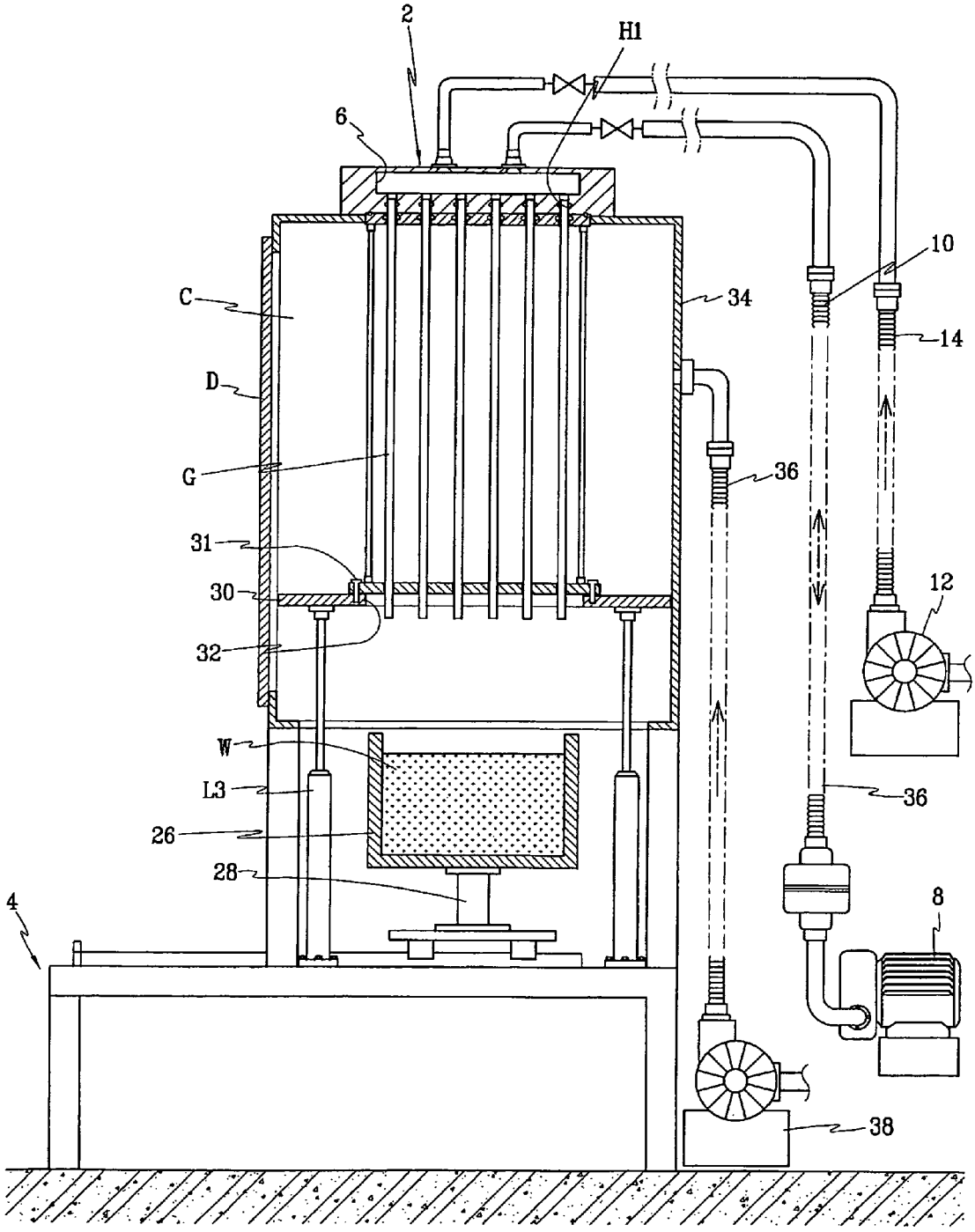
FIG. 1 is a view of a fluorescent material coating apparatus according to a first embodiment of the present invention.

FIG. 1 is a view of a fluorescent material coating apparatus according to the embodiment of the present invention. Reference numeral 2 indicates a delivery member, which is securely fixed on an upper portion of a frame 4, and a delivery chamber 6 is formed in the delivery member 2.

A vacuum pump 8 is connected to the delivery chamber 6 through a flexible pipe 10 so that a negative pressure can be generated in the delivery chamber 6, and a blower 12 having a heater (not shown) is connected to the delivery chamber 6 through a flexible pipe 14 so that hot air can be introduced into the delivery chamber 6. A plurality of communication holes H1 are formed on the delivery chamber 6 so that a plurality of glass tubes G can be inserted therein and communicate with the delivery chamber 6.

Figure 2:
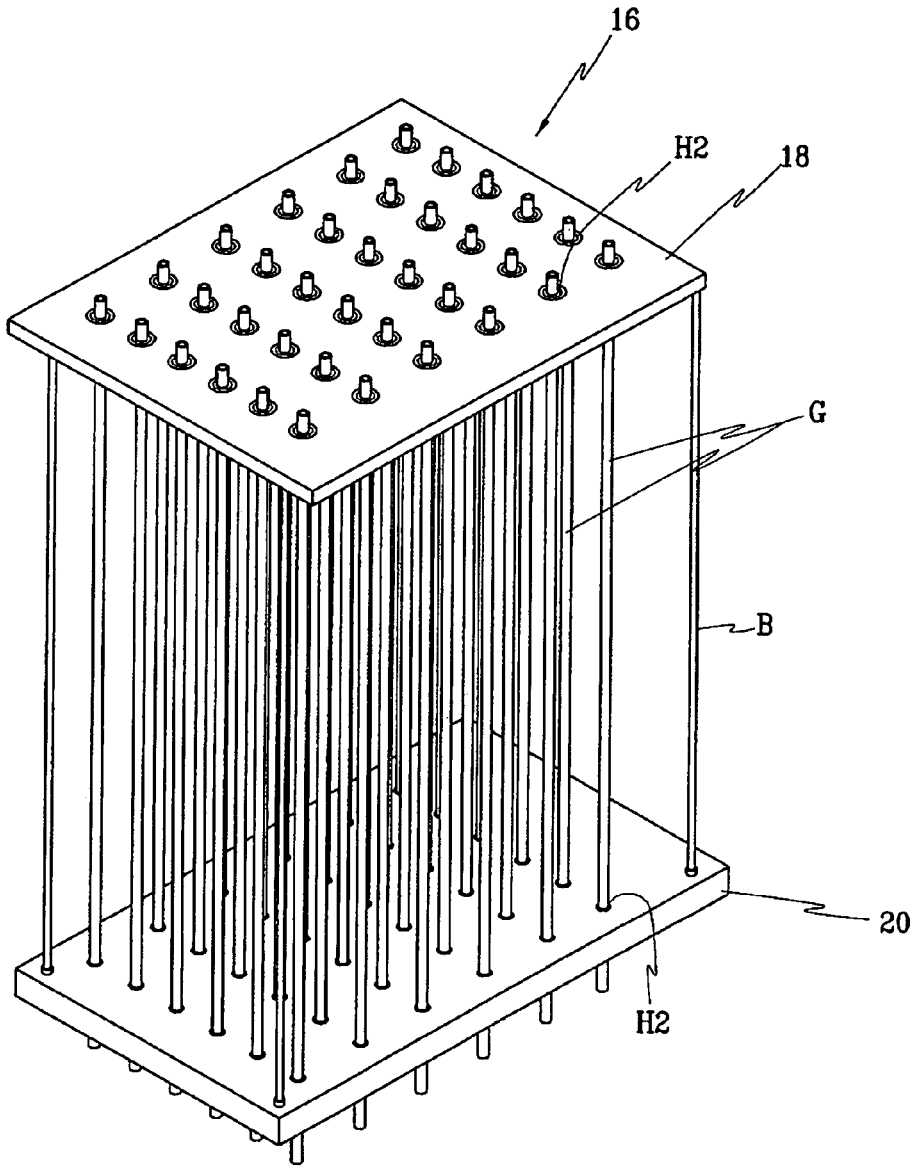
FIG. 2 is a perspective view of a cassette depicted in FIG. 1.

As shown in FIG. 2, the plurality of glass tubes G protrude so that they may be simultaneously inserted into the communication holes H1 of the delivery chamber 6 in a state where they are set in a cassette 16.

The cassette 16 includes upper and lower plates 18 and 20 through which a plurality of glass tube insertion holes H2 are formed, and fixing bars B for maintaining a predetermined distance between the upper and lower plates 18 and 20.

Figure 3:
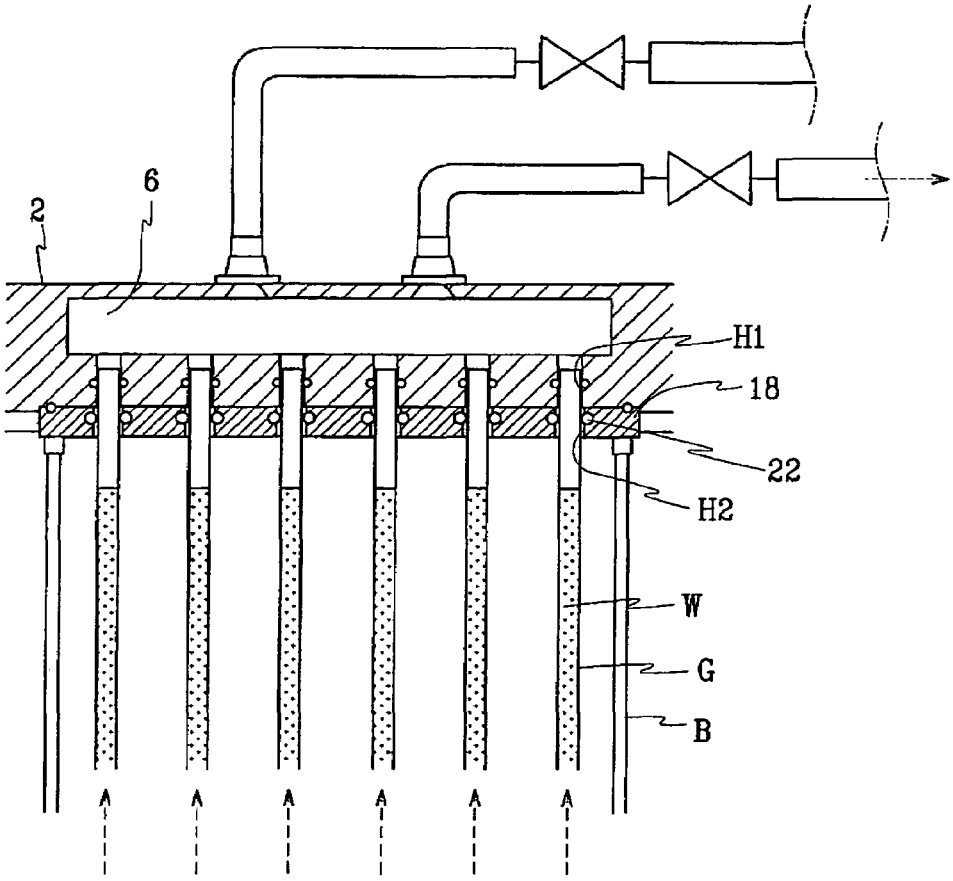
FIG. 3 is a view illustrating a fluorescent solution injecting process of a fluorescent material coating apparatus of the present invention.

As shown in FIG. 3, elastic rings 22 for applying a predetermined elastic force on outer circumferences of glass tubes that are inserted into the insertion holes H2 are installed on each insertion hole H2 to maintain the position of the glass tubes. The elastic rings 22 may be formed of an elastic material such as rubber.

Figure 4:
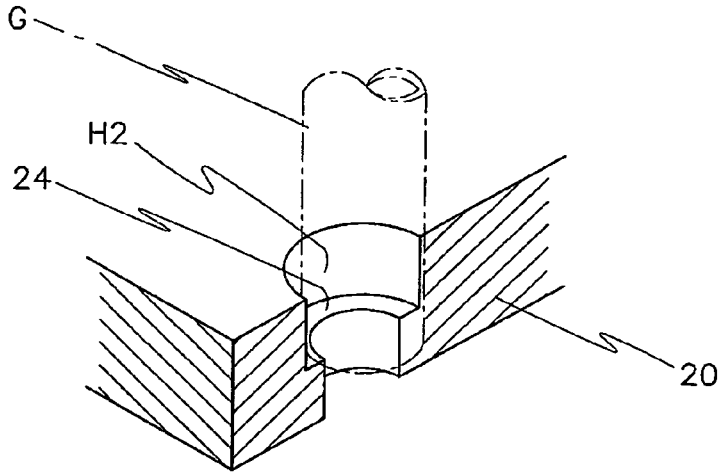
FIG. 4 is a view of a modified example of a hole portion of a cassette depicted in FIG. 2.

The apparatus must be designed such that the glass tubes G protrude above the upper plate 18 to be inserted into the communication holes H1 of the delivery chamber 6. Lower portions of the glass tubes G that are inserted into the glass tube insertion holes H2 of the lower plate may protrude as shown in FIG. 2, or a stepped portion 24 may be formed on the lower plate 20 such that the glass tubes G do not protrude and an end of the glass tube G can be located on the stepped portion 24 as shown in FIG. 4.

Figure 5:
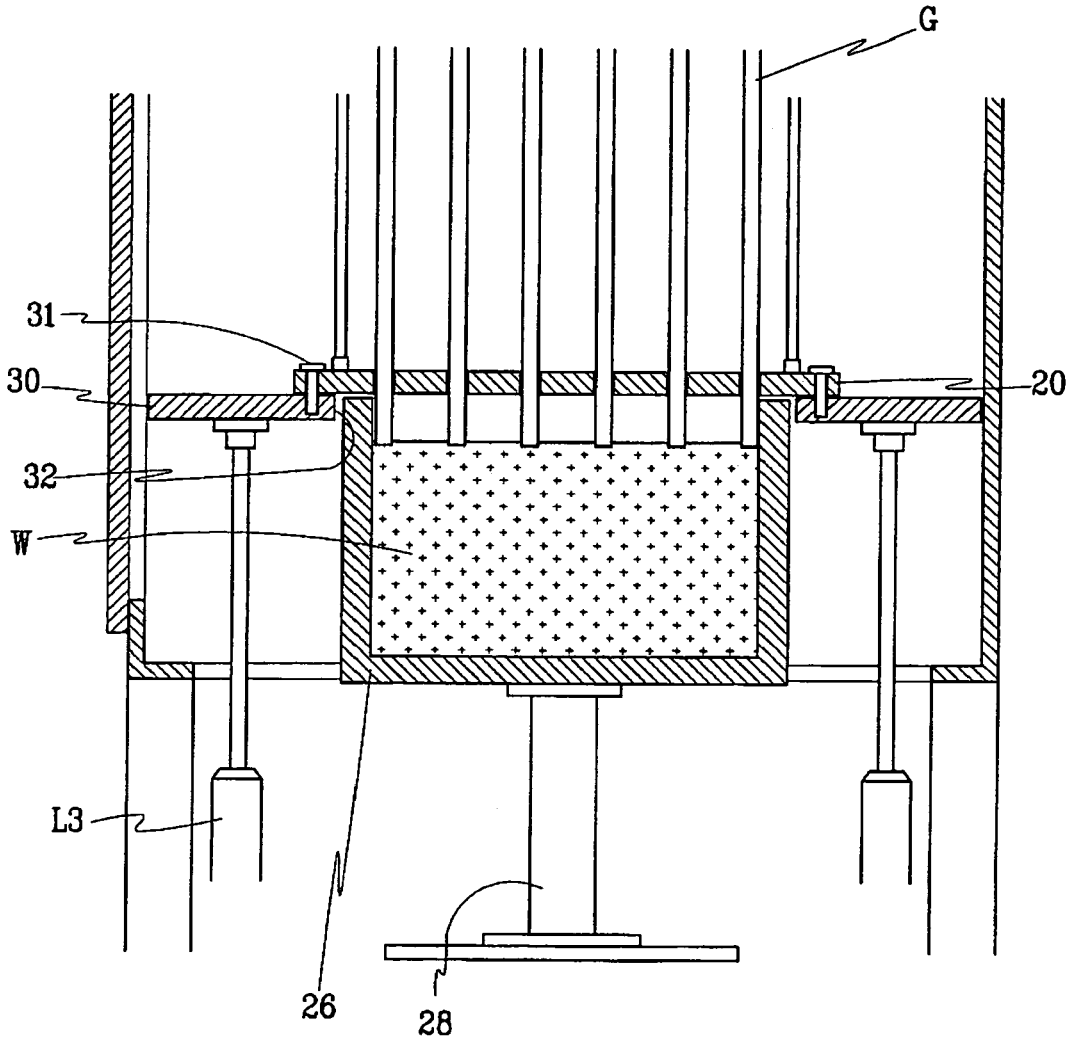
FIG. 5 is a view illustrating a contact state of a fluorescent solution with a glass tube of a fluorescent material coating apparatus of the present invention.

The frame 4 is formed such that there is a space for mounting the plurality of glass tubes G below the delivery member 2. As shown in FIG. 5, a solution tank 26 containing a fluorescent solution W that will be applied to the inner surfaces of the glass tubes G is located at a lower portion of the frame.

In order to apply the fluorescent solution W contained in the solution tank 26, at least one of the delivery members 2 and the solution tank 26 is installed to be vertically movable. In this embodiment, as shown in FIG. 5, the solution tank 26 is installed to be vertically movable by a cylinder 28 so that ends of the glass tubes G mounted to the delivery chamber 6 can be dipped in the fluorescent solution W.

In a state where first end portions of the glass tubes G are connected to the delivery chamber 6 and second end portions of the glass tubes G are partially dipped in the fluorescent solution W contained in the solution tank 26, the fluorescent solution W contained in the solution tank 26 is drawn into the glass tubes G by a negative pressure that is generated in the glass tubes G when the vacuum pump 8 is driven.

Figure 6:
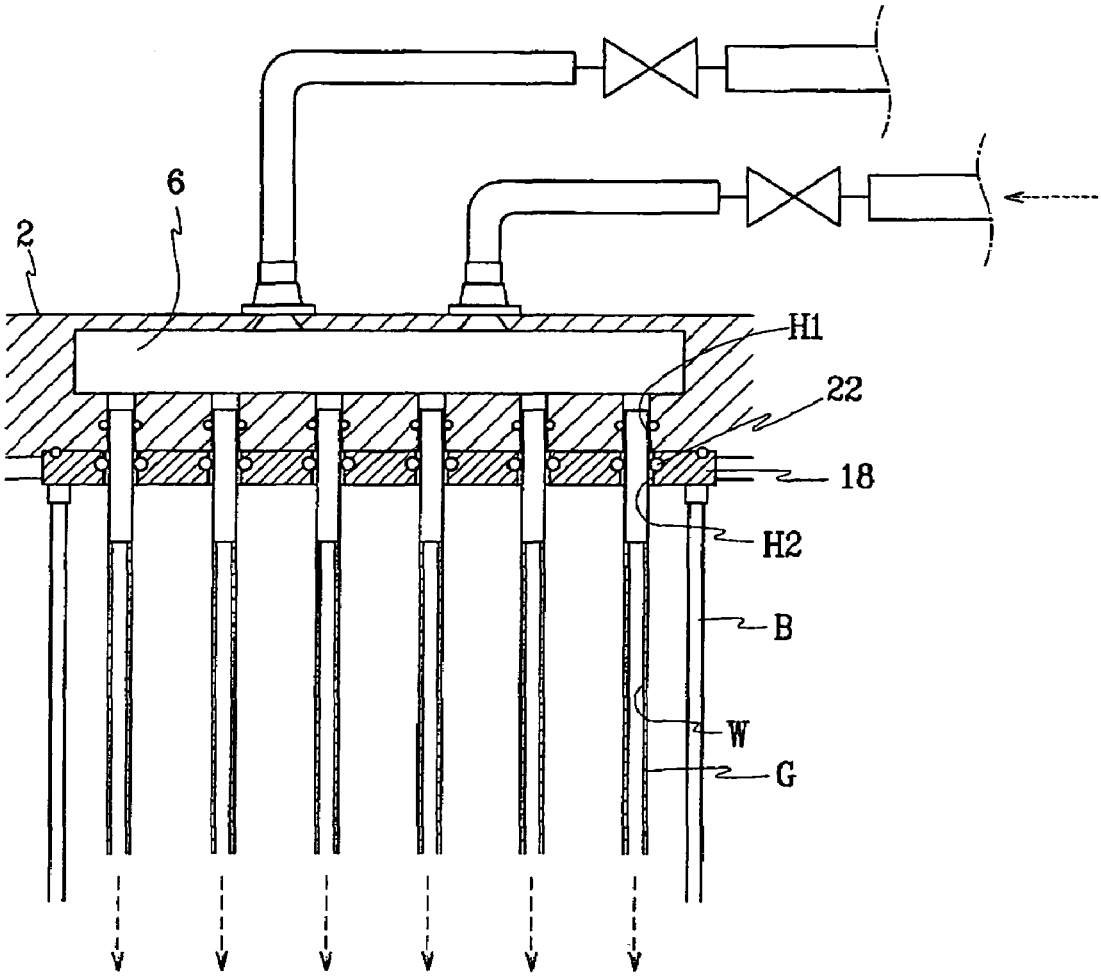
FIG. 6 is a view illustrating a fluorescent material discharging process of a fluorescent material coating apparatus of the present invention.

When the vacuum pump 8 stops, the fluorescent solution W drawn into the glass tubes G falls back to the solution tank 26 by gravity. At this point, as shown in FIG. 6, the fluorescent solution is applied to the inner surface of the glass tubes G. This operation can be realized because of the open upper portion of the solution tank 26.

The insertion holes H2 are arrayed to correspond to the communication holes H1 formed on a bottom surface of the chamber 6 to realize the above operation.

The cassette 16 can be loaded with a large number of the glass tubes G in the insertion holes H2 formed on the upper and lower plates 18 and 20. After the cassette 16 is disposed on a lift 30 installed inside the frame 4, it vertically moves by way of the lift 30, in the course of which the upper plate 18 moves to the bottom of the delivery member 2.

The lift 30 may be formed of a metal plate. An opening 32 that is smaller than the lower plate 20 of the cassette 16 is formed at the center bottom of the lift 30 so that lower ends of the glass tubes G can be projected downward through the opening 32 when the cassette 16 is mounted on the lift 30. This structure allows the lower ends of the glass tubes G to draw the fluorescent solution contained in the solution tank 26.

As a driving source for moving the lift 30, a plurality of cylinders L3 installed on the bottom surface of the frame 4 may be used. The lift 30 is horizontally fixed to the piston rod of the cylinders L3.

Locating pins 31 are installed on the lift 30 so that the cassette 16 can be stably located thereon. When the lift 30 ascends by way of the cylinders L3, the cassette 16 can stably move toward the delivery chamber and the glass tubes mounted on the cassette can be accurately inserted into the communication holes H1 of the delivery chamber 6.

A common chamber C for enclosing all of the glass tubes G loaded on the cassette 16 may be formed below the delivery chamber 6. That is, as shown in FIG. 1, a cover member 34 is installed between the delivery member 2 and the solution tank 26 to isolate the glass tubes G from the outside. The cover member 34 may be formed of a metal or synthetic resin, in a box shape. A door D through which the cassette is loaded and unloaded is installed at a side of the cover member 34.

The common chamber C also functions to identically maintain the outer, inner, upper, and lower temperatures of the glass tubes G while the applied fluorescent solution W is dried. That is, a flexible pipe 36 is connected between the cover member 34 and a blower 38 for supplying hot air. When a temperature in a range of about 100-150° C. is formed in the common chamber C, the object of the present invention can be realized. Particularly, because the temperature of the whole of the common chamber C is uniform, the difference between the outer and inner temperatures of the glass tubes when dry air is supplied into the glass tubes G to dry the fluorescent solution W in the prior art is reduced, thereby realizing uniform drying.

Figure 7:
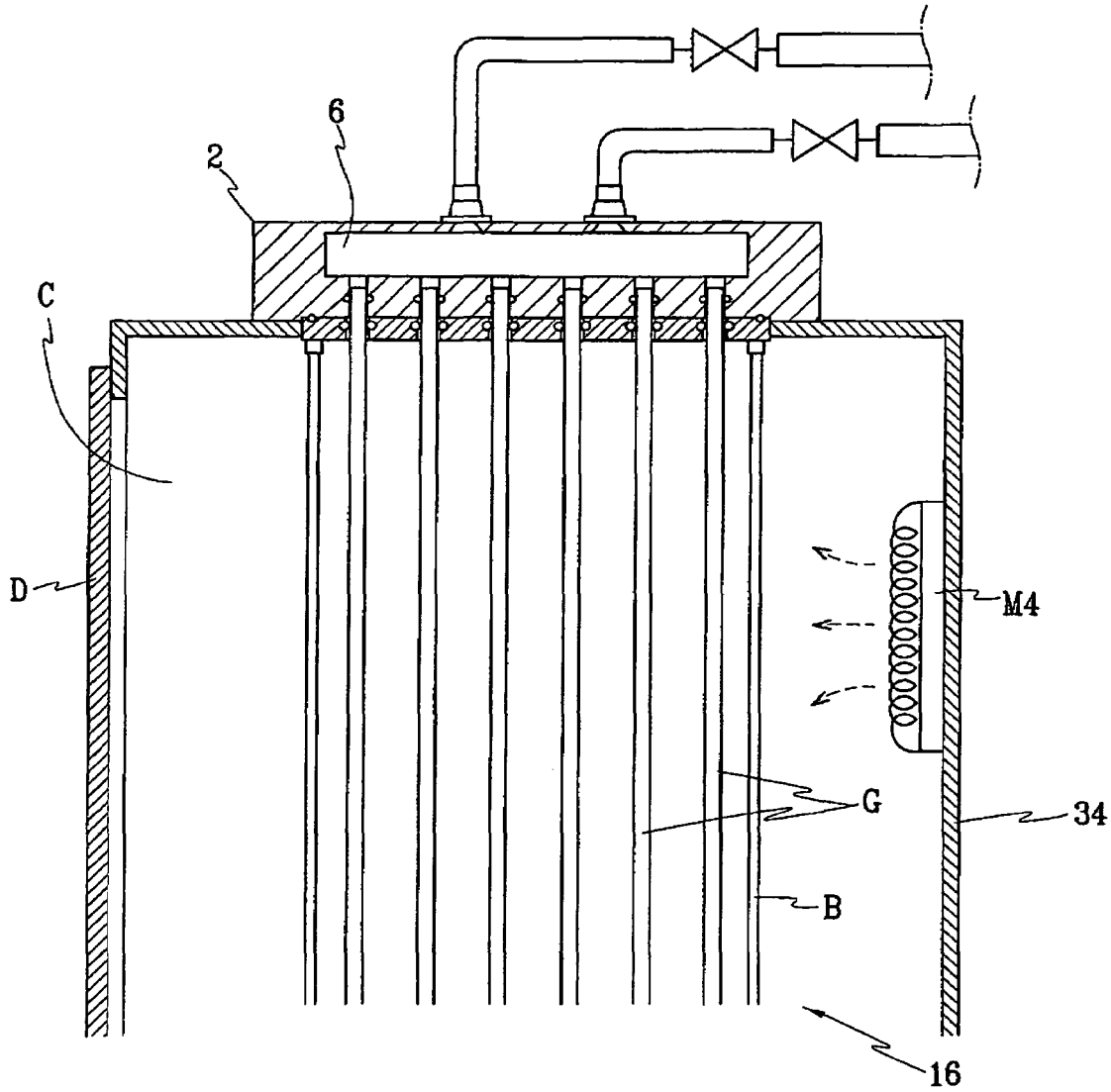
FIG. 7 is a view of a modified example of a hot air supplying unit depicted in FIG. 1.

FIG. 7 shows another example of supplying dry air to the common chamber C. In this example, one or more coil heaters M4 are installed inside the common chamber C to adjust the temperature therein. The heater M4 is not limited to the above structure, as other types of heaters may be used. Since the thermal conduction for increasing the temperature of the common chamber C occurs inside the common chamber C by the heating operation of the heater M4, thermal conduction efficiency can be improved.

Figure 8:
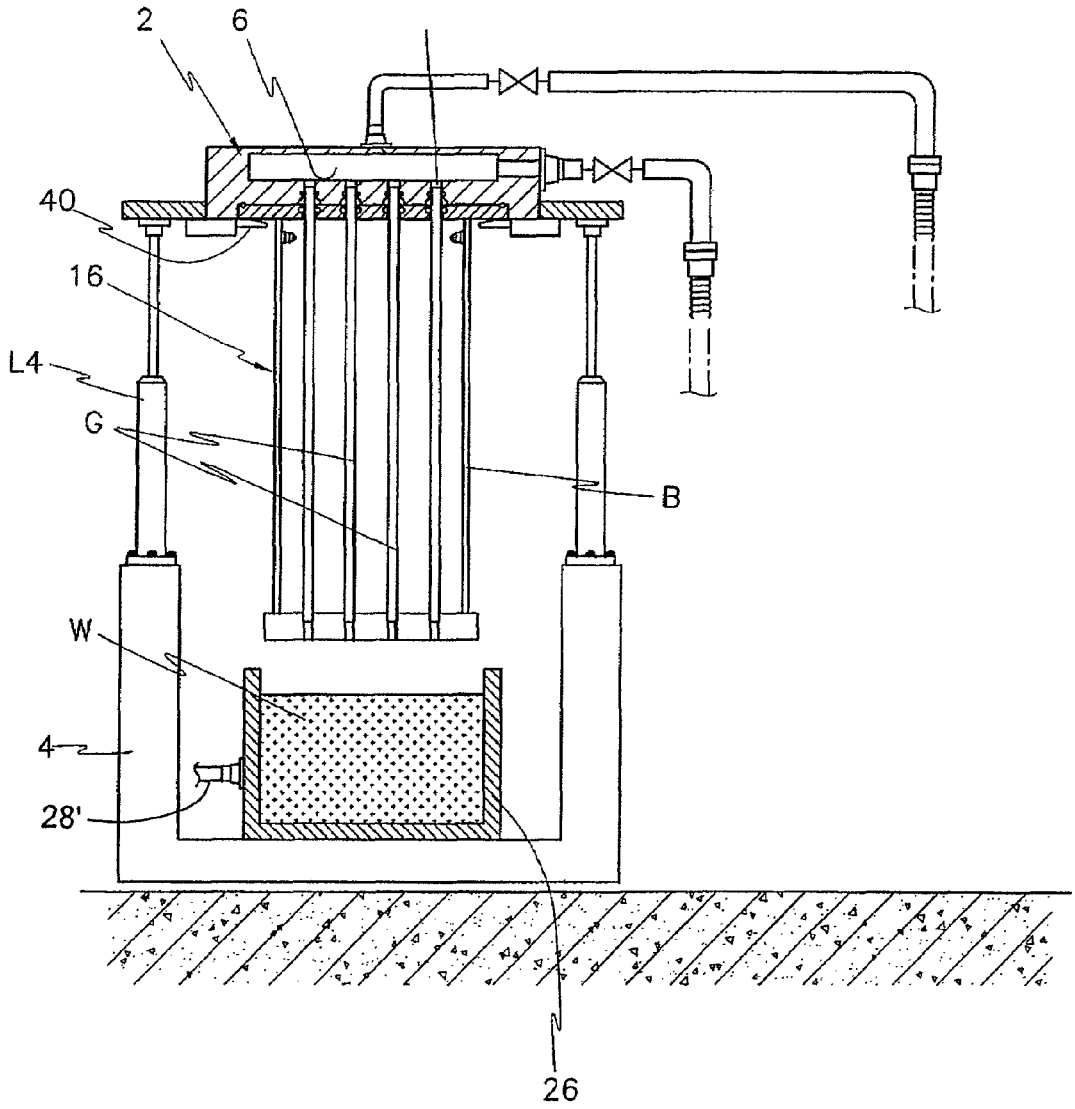
FIG. 8 is a view of a fluorescent material coating apparatus according to a second embodiment of the present invention.

FIG. 8 shows a fluorescent material coating apparatus according to a second embodiment of the present invention. In this embodiment, the delivery member 2 is designed to vertically move by way of the cylinders L4. Therefore, there is no cover member 34 in this embodiment.

When the cassette 16 is located below the delivery member 2, it is fixed to the bottom of the delivery member 2 by lock tabs 40. The lock tabs 40 may be formed to linearly move by way of the cylinder L4, or may be formed with a cam structure. In addition, other types of lock tabs may be possible.

In a state where the cassette 16 is fixed on the bottom of the delivery member 2 by the lock tabs 40, when the cylinders L4 operate, the cassette 16 moves together with the delivery member 2. In this embodiment, the solution tank 26 containing the fluorescent solution is fixed to the lower side of the frame 4.

Figure 9:
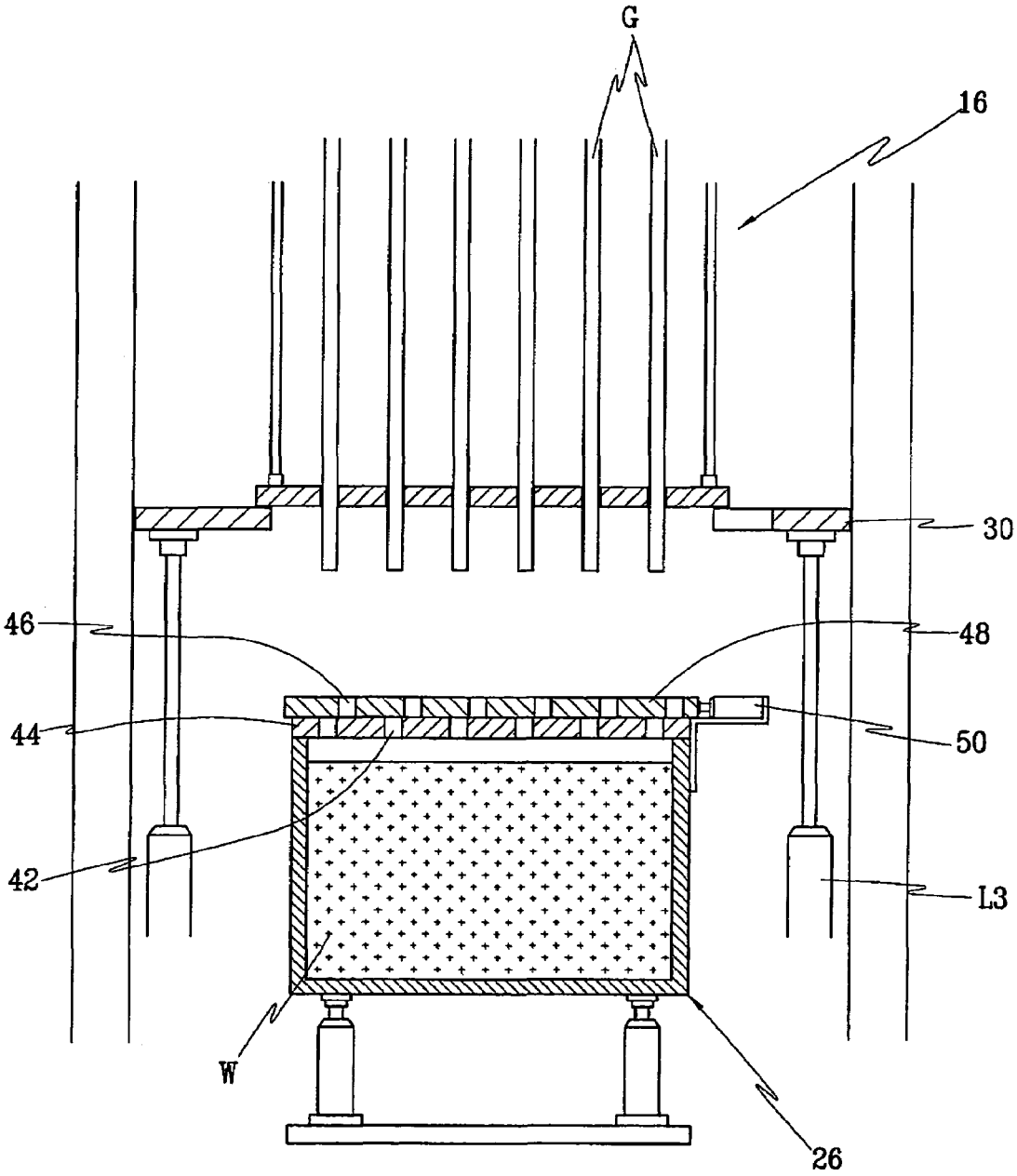
FIG. 9 is a view of a fluorescent solution volatilization preventing unit of the present invention.
Figure 10:
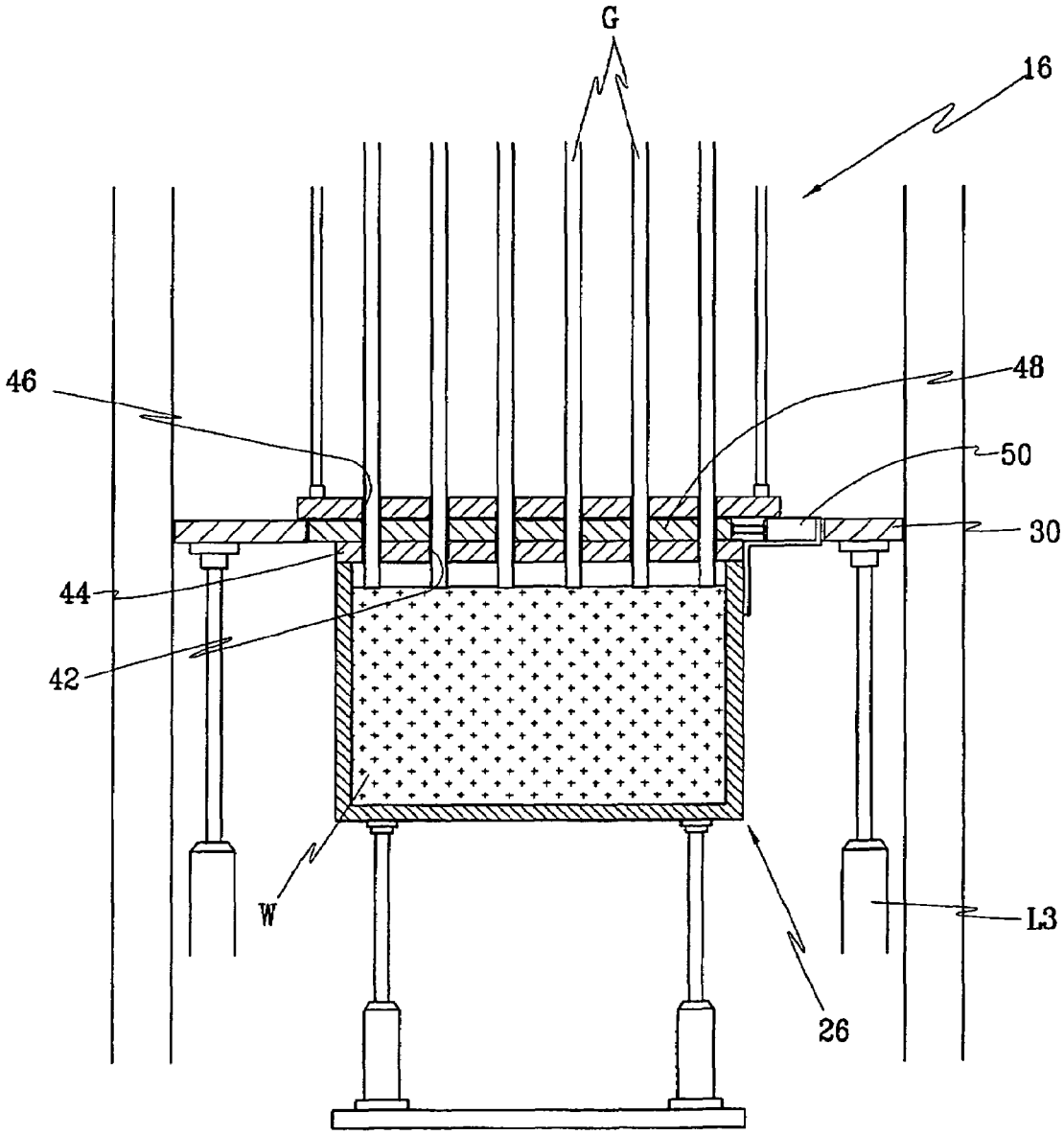
FIG. 10 is a view illustrating an opened state of a fluorescent volatilization preventing unit of the present invention.

FIGS. 9 and 10 show a fluorescent solution volatilization prevention unit of the present invention.

The solution tank 26 of the first embodiment has the opened upper end portion. However, in this embodiment, the upper end portion is designed to open and close according to circumstances.

A plate 44 having a plurality of holes covers the upper portion of the solution tank 26, as shown in FIG. 9. A moving plate 48 having a plurality of holes 46 corresponding to holes 42 of the plate 44 surface-contacts the plate 44. The moving plate 48 linearly or circumferentially moves by way of a driving unit 50 such as a cylinder or a motor, in the course of which the holes 42 of the plate 44 correspond to the holes 46 of the moving plate 48 as shown in FIG. 10 or are offset as shown in FIG. 9.

From the state of FIG. 10, since the ends of the glass tubes G are immersed into the solution tank 26 through the corresponding holes 42 and 46, the fluorescent solution can be drawn into the glass tubes G. The state of FIG. 9 shows the top of the solution tank 26 in a blocked state when the fluorescent solution is not in use.

Figure 11:
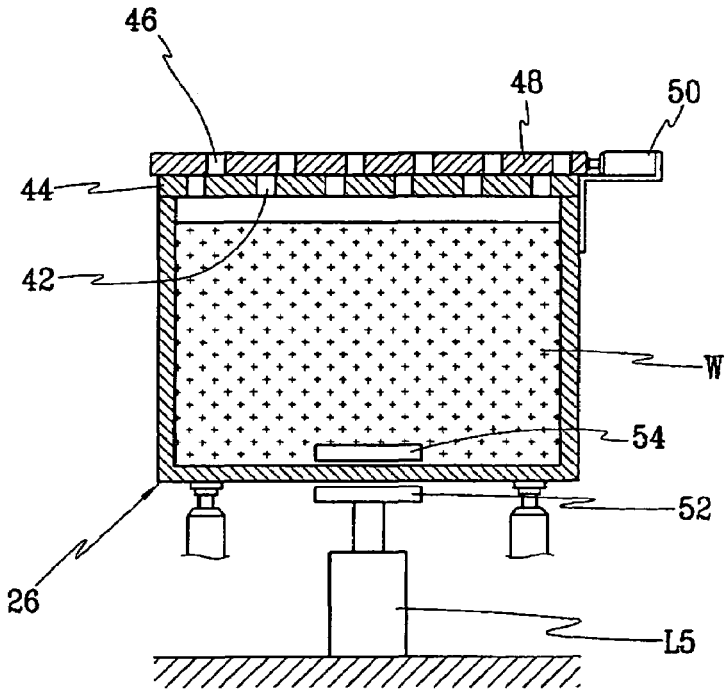
FIG. 11 is a view of a fluorescent material agitating unit of the present invention.

FIG. 11 is a view of a fluorescent material agitating unit of the present invention.

A rotor 52 that is driven by a rotational driving unit L5 is installed on a lower outer portion of the solution tank 26, and an agitator 54 facing the rotor 52 is located inside the solution tank 26. At least one of the rotor 52 and the agitator 54 is formed of a magnet, and the other is formed of a magnetic material. Therefore, when the rotor 52 rotates, the agitator 54 rotates inside the solution tank 26 to agitate the fluorescent solution. The rotational driving unit L5 may be a motor, a rotary cylinder, or the like.

The operation of the above-described fluorescent material coating apparatus and the coating method using the apparatus will now be described.

After the plurality of glass tubes are loaded in the cassette 16, the cassette 16 is moved to below the delivery member 2 by way of a moving unit such as a robot (not shown) so that the cassette 16 can be located on the lift 30 installed on the cylinders L3. At this point, the locating pins 31 installed on the lift 30 are inserted into locating holes (not shown) formed through the lower plate 20 of the cassette 16, thereby realizing accurate mounting of the cassette 16 on the lift 30.

In this state, when the cylinders L3 operate, the upper end portions of the glass tubes G loaded in the cassette 16 are inserted into the communicating holes H1 communicating with the delivery chamber 6, as shown in FIG. 1. Then, the solution tank 26 moves rightward in FIG. 1 to be located below the cassette 16. The movement of the solution tank 26 may be realized by, for example, a cylinder 28 or 28.

When the cylinder 28 operates in a state where the delivery chamber 6 communicates with the glass tubes G, the solution tank 26 moves upward so that the lower end portions of the glass tubes G dip into the fluorescent solution W. When the lower end portions of the glass tubes G dip slightly into the fluorescent solution, the operation of the cylinder 28 is stopped. In this state, when the vacuum pump 8 operates, the delivery chamber 6 is evacuated to reduce the pressure inside the glass tubes G, thereby allowing the fluorescent solution W to be drawn into the glass tubes G.

That is, as shown in FIG. 3, when the fluorescent solution is drawn into the glass tubes G to a predetermined level, the operation of the vacuum pump 8 is stopped to release the negative pressure state of the delivery chamber 6. As a result, the fluorescent solution drawn into the glass tube G falls to the solution tank 26 and the inner surfaces of the glass tubes G are coated with the fluorescent solution as shown in FIG. 6. The blower 12 then operates to supply hot air to the delivery chamber 6, and the hot air passes through the glass tubes G to dry the fluorescent solution W applied to the inner surfaces of the glass tubes G.

At this point, the cylinder 28 operates to return the solution tank 26 to its initial location. To uniformly maintain the drying temperature of the glass tubes, the hot air is introduced into the common chamber C through the flexible pipe 36 by the operation of the blower 38 and is then dispersed over the outer surfaces of the glass tubes G.

By the above-described operation, since the hot air is supplied to both the interior and exterior surfaces of the glass tubes G, the drying quality can be improved.

Furthermore, when the fluorescent solution applying process is not being undertaken, the plates 44 and 48 are set such that the holes 42 and 46 are offset to prevent the solvent of the fluorescent solution from being volatilized.

In addition, as shown in FIG. 11, when the agitator 54 is installed in the solution tank 26 and is driven by the driving unit L5, the fluorescent materials are uniformly mixed, thereby improving the coating quality.

According to the present invention, a fluorescent material coating apparatus can easily apply and dry a fluorescent material, coat a fluorescent material on a plurality of glass tubes at once, and improve the coating quality by providing a uniform drying temperature to the glass tubes during the drying process.

Furthermore, the top of the solution tank can be opened only when required, so the viscosity of the fluorescent solution can be uniformly maintained. In addition, since the fluorescent solution can be agitated in the solution tank, the fluorescent solution can be uniformly applied.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A fluorescent material coating apparatus for a fluorescent lamp, comprising:

a cassette on which a plurality of glass tubes are detachably mounted;

a delivery member having a delivery chamber communicating with first ends of the glass tubes;

a cover member disposed below the delivery member to separate the glass tubes from an external side and connected to a hot air supplying unit, the hot air supplying unit comprising a heater installed inside the cover member;

a negative pressure generating unit for allowing a fluorescent solution to be drawn into the glass tubes by generating negative pressure in the glass tubes communicating with the delivery chamber by lowering the pressure of the delivery chamber;

a dry air supplying unit for supplying dry air to the delivery chamber to dry the fluorescent solution applied to inner surfaces of the glass tubes;

a solution tank disposed below the glass tubes mounted on the cassette and containing the fluorescent solution; and a moving unit for allowing lower end portions of the glass tubes mounted in the delivery chamber to be dipped into the fluorescent solution contained in the solution tank.

2. The fluorescent material coating apparatus of claim 1, wherein the delivery chamber is connected to the negative pressure generative unit and to the hot air supplying unit.

3. The fluorescent material coating apparatus of claim 1, wherein the cassette includes upper and lower plates spaced apart from each other, the plates being provided with a plurality of holes into which the glass tubes are inserted.

4. The fluorescent material coating apparatus of claim 3, wherein the lower plate is provided with stepped portions around the holes where the glass tubes are disposed.

5. The fluorescent material coating apparatus of claim 1, wherein the hot air supplying unit heats the atmosphere within the cover member to a temperature of about 100-150°C.

6. The fluorescent material coating apparatus of claim 1, wherein the delivery member is installed to be vertically movable by a driving unit.

7. The fluorescent material coating apparatus of claim 1, wherein the solution tank is installed to be vertically movable by a driving unit.

8. The fluorescent material coating apparatus of claim 1, wherein the solution tank is installed to be horizontally movable by a cylinder.

9. The fluorescent material coating apparatus of claim 1, further comprising a volatilization preventing unit provided on the solution tank to prevent the volatilization of the fluorescent solution.

10. The fluorescent material coating apparatus of claim 9, wherein the volatilization preventing unit includes a hole plate having a plurality of holes and a moving plate disposed to face the hole plate.

11. The fluorescent material coating apparatus of claim 1, further comprising an agitating unit disposed in the solution tank to agitate the fluorescent solution contained in the solution tank.

12. The fluorescent material coating apparatus of claim 11, wherein the agitating unit includes a rotor that is disposed at an outer side of the solution tank and an agitator that is disposed inside the solution tank and that cooperates with the rotor.

13. The fluorescent material coating apparatus of claim 12, wherein at least one of the rotor and the agitator is formed of a magnet.

14. A fluorescent material coating apparatus for a fluorescent lamp, comprising:

a cassette on which a plurality of glass tubes are detachably mounted;

a delivery member having a delivery chamber communicating with first ends of the glass tubes;

a negative pressure generating unit for allowing a fluorescent solution to be drawn into the glass tubes by generating negative pressure in the glass tubes communicating with the delivery chamber by lowering the pressure of the delivery chamber;

a dry air supplying unit for supplying dry air to the delivery chamber to dry the fluorescent solution applied to inner surfaces of the glass tubes;

a solution tank disposed below the glass tubes mounted on the cassette and containing the fluorescent solution;

a moving unit for allowing lower end portions of the glass tubes mounted in the delivery chamber to be dipped into the fluorescent solution contained in the solution tank; and a volatilization preventing unit provided on the solution tank to prevent the volatilization of the fluorescent solution.

15. The fluorescent material coating apparatus of claim 14, wherein the volatilization preventing unit includes a hole plate having a plurality of holes and a moving plate disposed to face the hole plate.

* * * * *